US005580288A

United States Patent [19]

Marinc

[11] Patent Number: 5,580,288

[45] Date of Patent: Dec. 3, 1996

[54] BELT DRIVEN PEDAL BOAT

[76] Inventor: Victor Marinc, 2053 E. Bayshore Rd., Space II, Redwood City, Calif. 94063

[21] Appl. No.: 536,081

[22] Filed: Sep. 29, 1995

[51] Int. Cl.[6] ..... B63H 16/20

[52] U.S. Cl. ..... 440/29

[58] Field of Search ..... 440/12, 24, 29, 440/30; 474/113

[56] References Cited

U.S. PATENT DOCUMENTS

| | | | |
|---|---|---|---|
| 2,775,950 | 1/1957 | Dearmond | 115/25 |
| 2,940,415 | 6/1960 | Schwarzer | 440/29 |
| 2,960,058 | 11/1960 | Magnani | 440/30 |
| 3,225,733 | 12/1965 | Schwarzer | 440/30 |
| 4,140,076 | 2/1979 | Borglum | 115/26 |
| 4,648,846 | 3/1987 | Hsu | 440/31 |
| 4,891,024 | 1/1990 | Benjamin | 440/28 |
| 5,183,422 | 2/1993 | Gulboche | 440/26 |

FOREIGN PATENT DOCUMENTS

| | | | |
|---|---|---|---|
| 2120390 | 5/1973 | Germany | 440/29 |

*Primary Examiner*—Sherman Basinger
*Attorney, Agent, or Firm*—Robert Samuel Smith

[57] ABSTRACT

A pedal drive apparatus for mounting in a boat such as on the rear gunwale of a typical rowboat featuring a drive wheel coupled to a crankshaft and also coupled to a propeller shaft through a bi-directional pulley system. Coupling between pedal crankshaft and flywheel and between the flywheel and propeller pedal is achieved with belts. A bicycle style seat with handle bars for steering is featured and a handgrip lever on the handlebar enables the user to lock the steering wheel in a temporary orientation.

7 Claims, 4 Drawing Sheets

BELT DRIVEN PEDAL BOAT

FIELD OF THE INVENTION

This invention is directed toward pedal boats and particularly to a boat driven by pedals coupled to the propeller by a belt system.

BACKGROUND AND PRIOR ART

Pedal boats have been in the market place as a source of leisure and relaxation for members of the public. Various constructions have been reported.

For example, U.S. Pat. No. 2,775,950 to Dearmond discloses a pedal propelling attachment for boats in which a pedal crankshaft turned by the seated user, is coupled by a sprocket chain to a propeller drive shaft. The construction requires two right angle gear drives, one right angle gear drive coupling the sprocket gear system to a vertical drive shaft outside the rear of the boat and a second second right angle gear drive that couples the lower end of the vertical drive shaft to the horizontal propeller shaft under the boat. The driver's seat is coupled to the housing of the vertical drive shaft such that the user can steer the boat by turning his seat thereby steering the boat by turning his body leaving his hands free.

U.S. Pat. No. 4,648,846 to Hsu discloses a pedal boat wherein the boat is two pontoons supporting a seat and foot operated paddling arrangement. A vertical drive tubular shaft is coupled by bevel gears at an upper end to the crankshafts of a pair of pedals and at the lower end by a second transmission gear to a propeller shaft. A steering shaft enclosed by the tubular vertical drive shaft is coupled at an upper end to a steering member and at its lower end to the propeller housing so that rotation of the steering member by the operator changes the orientation of the propeller housing to steer the boat.

U.S. Pat. No. 4,140,076 to Borglum discloses a paddle wheel arrangement with two pairs of pedals, one pair on one side and the other pair on an opposite side of the paddle wheel. The steering mechanism includes a rudder operated with a rudder arm located in the center of the boat.

U.S. Pat. No. 4,891,024 discloses the shaft of a pair of pedal cranks coupled by a drive shaft with universal joint to a vertical shaft which is coupled by a pair of bevel gears to a horizontal propeller shaft. The steering mechanism includes a lever arm configured similar to the gear shifting stick of an automobile coupled to a rotatable steering column supporting the propeller housing.

U.S. Pat. No. 5,183,422 to Gulboche discloses a pair of paddlewheels coupled to a pedal crank shaft by a belt in which the "boat" is a float, (similar to a large automobile tire inner tube) with a central opening where the paddlewheel is located under the seat of the driver. Steering is accomplished by controlling rotation of the paddle wheels relative to one another.

The foregoing disclosures are characterized by at least one of the following limitations.

1. The pedal systems of the cited art such as those incorporating a paddlewheel is integral with the construction of the boat.
2. The power loss in transmitting power from the pedals to the propeller is inherently increased using transmission systems incorporating universal joints.
3. Power is not conserved such as can be achieved by incorporation of a flywheel 5. Gear drive and sprocket drive introduce certain inherent requirements such as greasing, and construction costs such as mounting components to close tolerances, loss of tolerances, increased necessity for environmental protection, etc.
6. The seating arrangement is not designed for greatest efficiency of the pedalling and steering operations.

OBJECTS

It is an object of this invention to provide a boat propelling system which can be mounted onto or demounted from the typical rowboat.

It is a further object that operation of the boat propelling system be similar to riding a bicycle in terms of the seating, pedalling and handlebar arrangement that is typical of bicycle construction thereby providing for an efficient pedalling and steering effort.

It is another object that power efficiency be inherent by virtue of a belt drive and flywheel arrangement that conserves energy and avoids loss of torque by designs such as characterize the use of universal joints.

It is another object to reduce maintenance costs and inconveniences such as associated with a requirement for frequent lubrication of gears and sprocket chains to reduce friction losses and corrosion in a marine environment.

SUMMARY

This invention is directed toward a pedal assembly coupled to a propeller shaft through a flywheel assembly and right angle power transmission arrangement. The propeller assembly including the propeller on the propeller shaft is mounted on a vertical propeller drive shaft whose casing turns in response to steering performed by the user. The pedal assembly, flywheel assembly, orientable pulley assembly and propeller assembly are all coupled together by drive belts which eliminates lubrication chores. The drive apparatus is clamped on the rear gunwale of the typical row boat and is conveniently removable.

DESCRIPTION OF A PREFERRED EMBODIMENT

Figure 1:
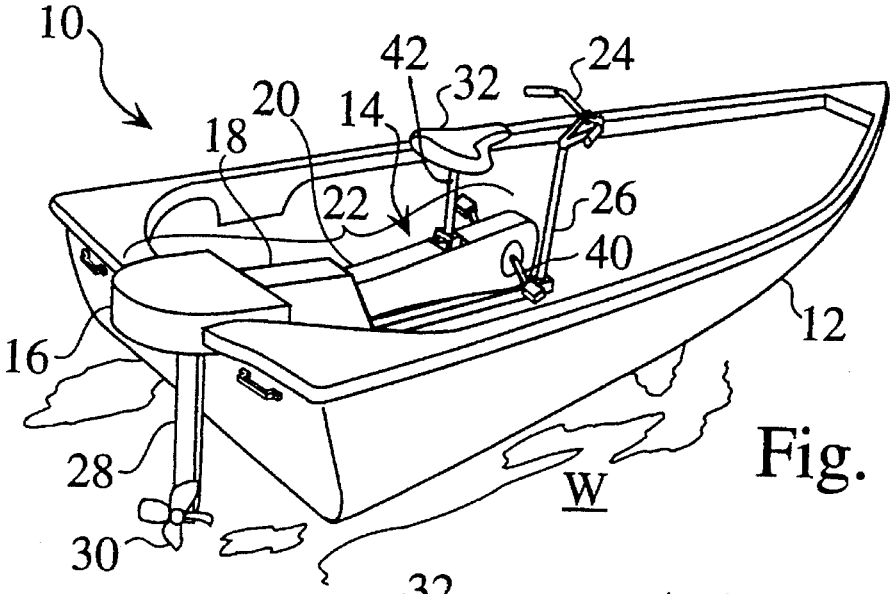
FIG. 1 is a perspective view of the boat and driving assembly.

Turning to a discussion of the drawings, the table lists items numbered in the drawings

TABLE

10 boat and pedal driven assembly
12 Boat
14 drive assembly
16 rear protective cover
18 central protective cover
20 front protective cover
22 protective cover set
24 handle bar
26 handle bar post
28 propeller drive casing
30 propeller
32 seat
35 carrier frame
36 main crank pulley
37 main crank belt
38 crank pulley post
40 pedal assembly
42 seat support post
44 seat support post brace
46 steering lock cable assembly
48 steering lock
50 detail view of flywheel unit
52 upper carrier frame
54 front carrier bracket
56 rear carrier bracket
58 first transfer pulley
60 flywheel shaft
62 second transfer pulley
64 flywheel
66 rear transfer unit
68 third transfer pulley
70 fourth transfer pulley
72 second drive belt
74 propeller drive belt
76 propeller drive fastening base
78 tie rod
80 steering pivot assembly
84 steering lock control
86 handle bar stem
88 steering link
90 rear pivot shaft
92 rear transfer shaft assembly bearing
98 bi-directional pulley assembly
100 first bi-directional pulley
102 second bi-directional pulley
103 pulley carrier pivot pin
104 bi-directional pulley carrier
105 propeller drive belt transfer tension adjustment screw
108 steering stabilizer
110 propeller pulley
112 propeller shaft
114 propeller drive casing fastener
120 steering lock plate
122 protective cover attachment bracket FIG. 1 is a perspective view of the invention 10 showing driving assembly 14 mounted in boat 12. Drive assembly 14 includes a handle bar 24 mounted on a vertical handle bar post 26 and a bicycle seat 32 mounted on the upper end of vertical seat support post 42.

The lower ends of posts 26 and 42 and other pans of the drive mechanism are covered by a protective cover set 22. Cover set 22 has three sections including a rear protective section 16, a central protective cover 18 and a front protective cover 20. A propeller 30 is shown mounted on the lower end of propeller drive casing 28. A pedal assembly 40 including a pedal mounted on pedal crank is shown extending from the front section 20 of cover 22.

Figure 2:
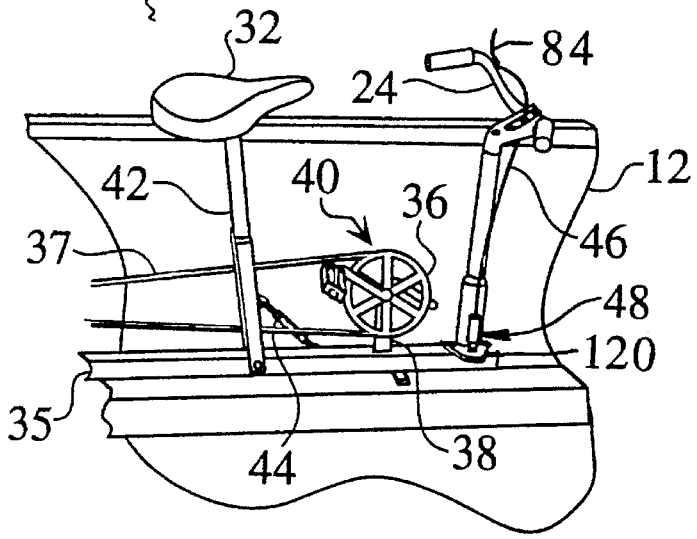
FIG. 2 is a side view of the drive assembly and steering mechanism.

FIG. 2 is a partial view of FIG. 1 with cover 22 removed to show the pedal assembly 40 coupled to main crank pulley 36 mounted on crank pulley post 38. Main crank belt 37 extends rearward from crank pulley 36. Seat support post 42 has a lower end pivotally attached to carrier frame member 35 and is adjustable by seat support brace 44. Steering lock pin 48 is attached to a lower end of steering lock assembly cable 46 whose upper end is fastened to steering lock lever 84 mounted on handlebar 24. When lever 84 is squeezed, spring loaded lock pin 48 is withdrawn from a hole in steering lock plate 120 releasing the handlebar 24 from a fixed straight orientation, allowing the user to turn the handlebar 24.

Figure 3:
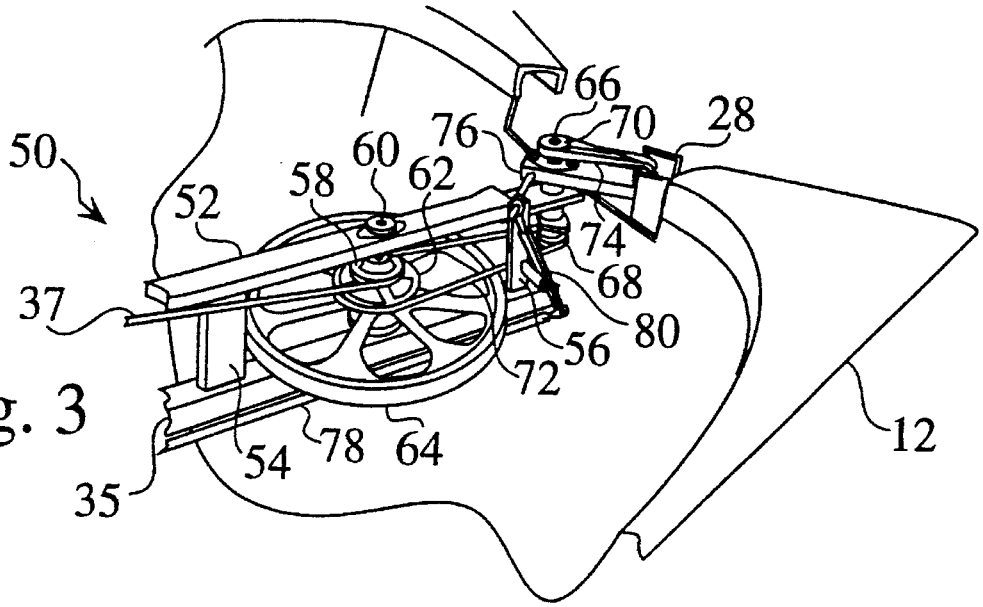
FIG. 3 is a rear side view of the mechanism showing the fly wheel with two pulleys.

FIG. 3 is a view of a flywheel section 50 rearward from the pedal assembly 40 showing the fly wheel 64 with two pulleys, 58 and 62 mounted on carrier frame member 35. One pulley 58 is coupled to main crank pulley 36 by belt 37 and the other pulley 62 is coupled by belt 72 to a third transfer pulley 68. Pulleys, 68 and 70, are both mounted on vertical transfer shaft 66 and coupled together. Pulley 70 is coupled by propeller drive belt 74 to propeller pulley 110 mounted on propeller shaft 112 (FIG. 6A).

Figure 6A:
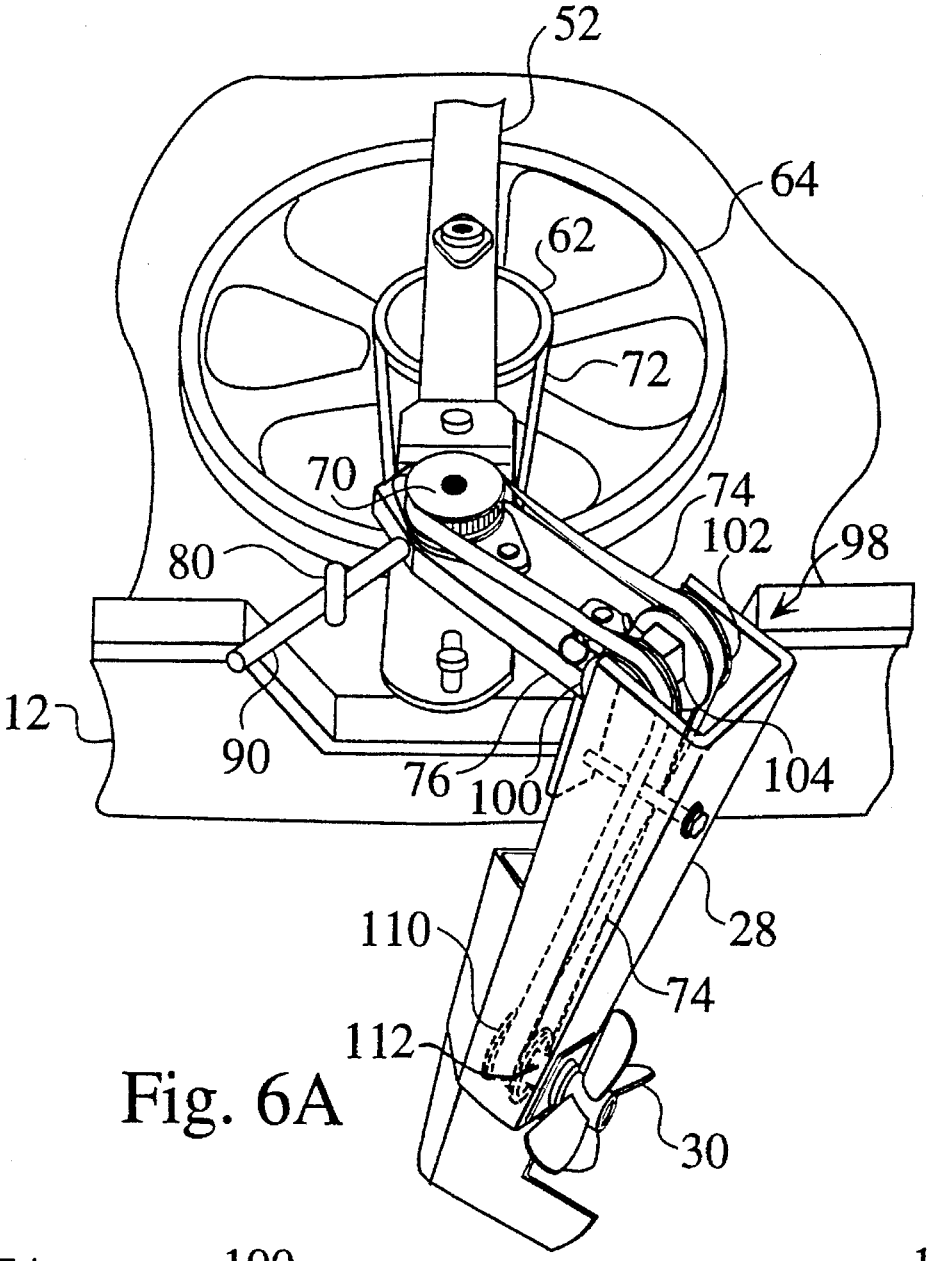
FIG. 6A is a side view of the propeller drive assembly.
Figure 6B:
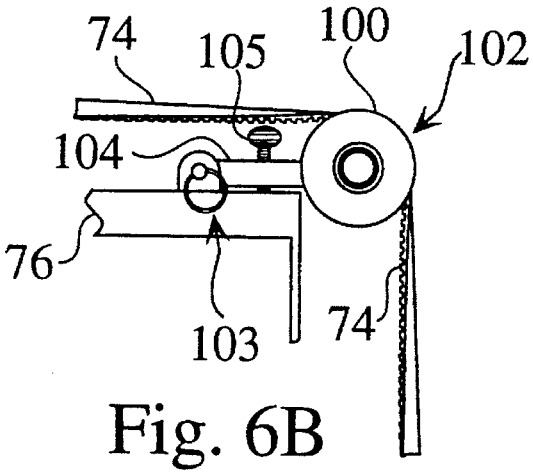
FIG. 6B shows the belt adjustment screw.
Figure 6C:
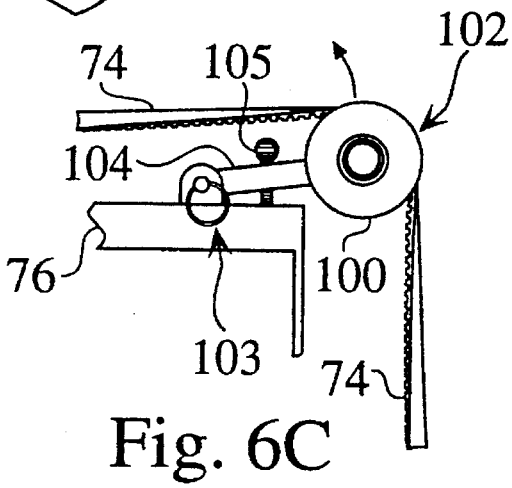
FIG. 6C shows the maximum adjustment position of the belt.

FIG. 6A–C show details of the bi-directional pulley assembly 98 for coupling together the propeller to the flywheel section such that the propeller can be turned for steering purposes. Belt 74 from transfer pulley 70 passes over bi-directional pulleys 100 and 102 to propeller pulley 110. Bi-directional pulleys 100 and 102 are rotationally mounted on bi-directional pulley carrier 104. Carrier 104 is pivotally mounted to rotate on pin 103 on an end opposite the bi-directional pulleys so that tension in belt 74 can be adjusted by adjustment screw 105. Adjustment of tension of belt 74 is illustrated by comparing FIG. 6B to FIG. 6C. The entire propeller assembly and bi-directional pulley assembly are mounted on one end of a propeller drive fastening base 76 which is mounted on an opposite end to swivel around transfer shaft 66.

Figure 4:
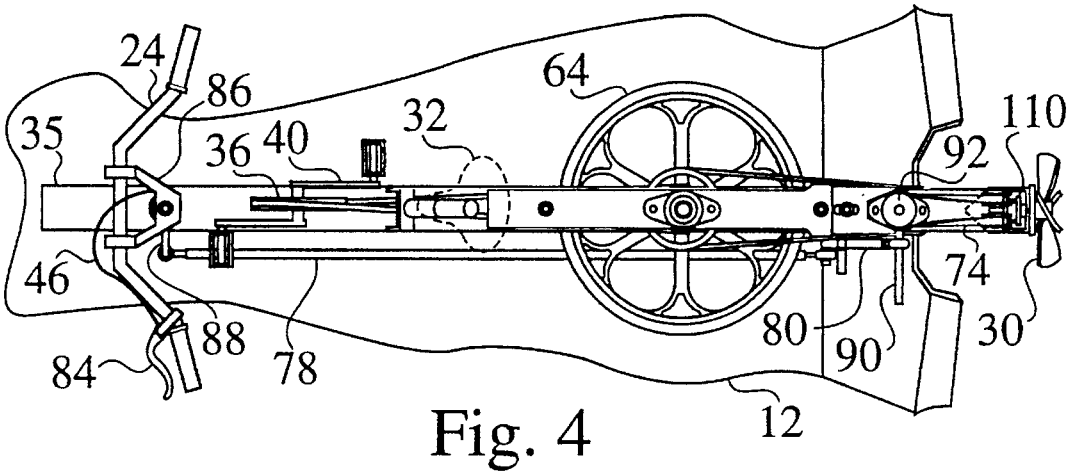
FIG. 4 is a top view of the invention.
Figure 5:
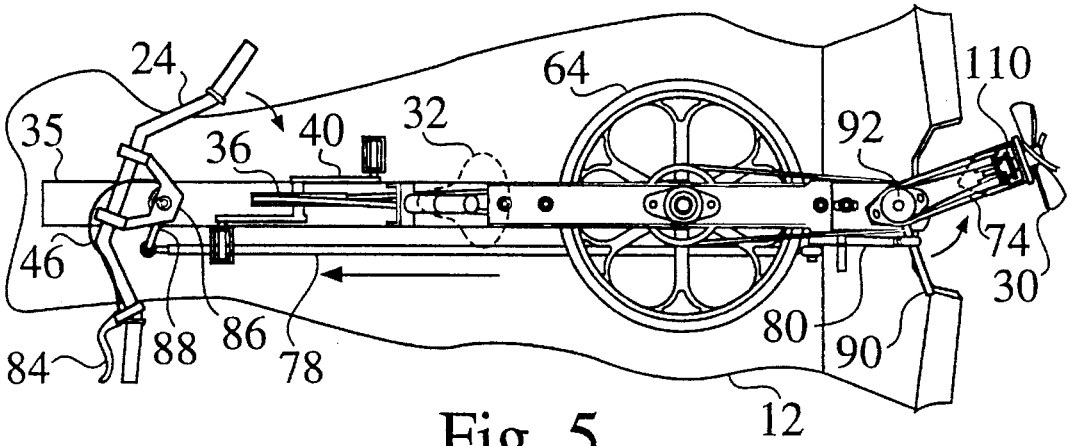
FIG. 5 is a top view showing the handlebar and propeller drive casing.
Figure 9:
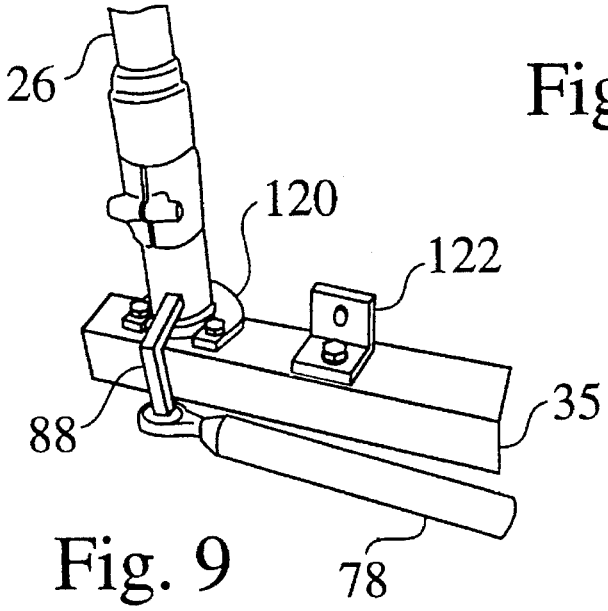
FIG. 9 shows the handle bar post and steering link.

FIG. 4 and 5 are top views of the invention illustrating the steering mechanism by showing the handle bar in two positions. As shown in FIG. 9, tie rod 78 is pivotally coupled by steering link 88 to handlebar post 26 on one end and to steering pivot assembly 80 on the other end. Rear pivot shaft 90 is part of the steering pivot assembly 80 and is secured to turn propeller drive fastening base 76 in response to turning the handle bar 24.

A hand operated lever 84 (FIG. 5) mounted on handlebar 24 controls tension in cable 46 linked to steering lock collar 48 (FIG. 2) when the user desires to maintain the handlebar in a fixed orientation for steering straight ahead by releasing lever 84.

Figure 7:
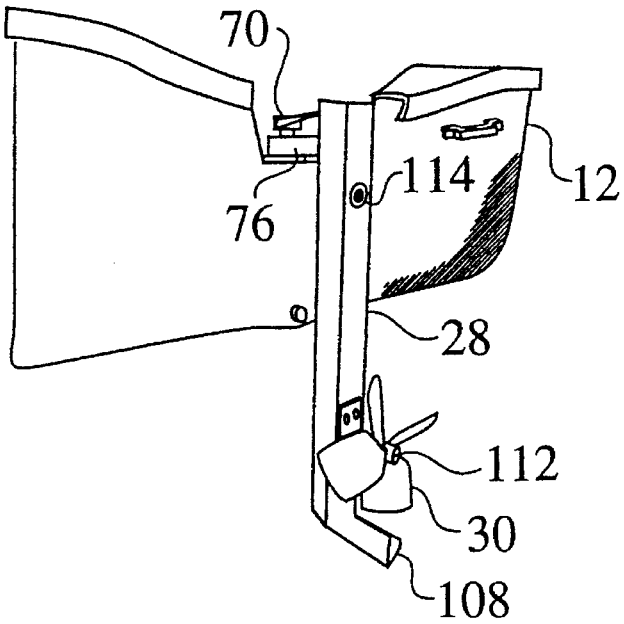
FIG. 7 is a rear view of the boat showing the propeller drive casing with the propeller.

FIG. 7 show details of the propeller assembly to greater advantage including propeller drive casing fastener 114 to secure the propeller drive casing 28.

Figure 8:
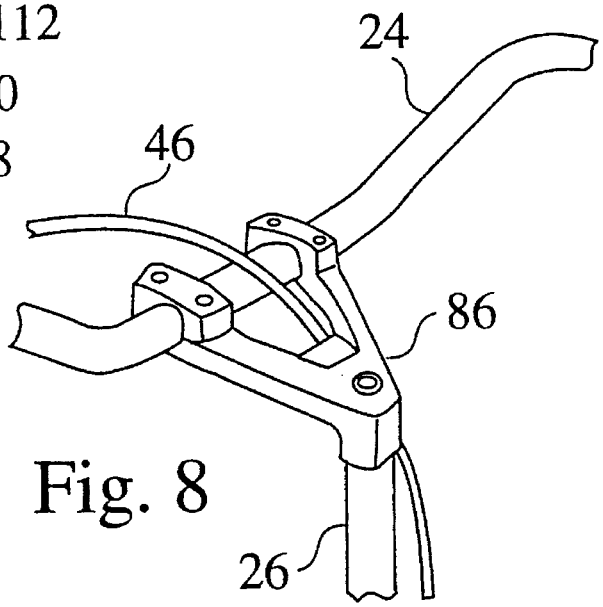
FIG. 8 shows the handle bar and part of the cable which locks the steering system.

FIG. 8 shows details of the handlebar construction including a handlebar stem 86 for mounting the, handlebar 24 onto the handlebar post 26 and a lever operated cable 46 for releasing the handle bar steering column 26 from locked straight ahead direction by simply squeezing the lever handle 84 as discussed above.

FIG. 9 shows details of the coupling of the tierod 78 through steering link 88 to handlebar column 26.

Other structural support features are shown in FIGS. 1, 3, 5, 7 and 9 including upper carrier frame 52, front carrier bracket 54, rear carrier bracket 56, wheel shaft 60, rear pivot shaft 90, rear transfer shaft assembly bearing 92, steering stabilizer 108, and protective cover attachment bracket 122.

The foregoing description illustrating the invention includes features that satisfy the objects of the invention. The seating and handlebar arrangement accommodate the requirements of the user preferring a bicycle type of construction for ease in steering and providing maximum leg power for pedalling. The absence of sprocket wheels, universal joints and gears eliminates the need for lubrication and reduces maintenance requirements. The apparatus is conveniently mounted in the boat for use and removed for storage. Variations and modifications of the invention may be suggested by reading the specification and studying the drawings which are within the scope of the invention. I therefore wish to define the scope of my invention by the attached claims.

I claim:

1. A pedal drive apparatus adapted for driving a boat which comprises:

a frame;

a pedal assembly (40) being a pair of pedal cranks and a main crank pulley (36) mounted on a crankshaft;
said crankshaft rotatably mounted on said frame;

a flywheel means having a flywheel (64), a first transfer pulley (58) and a second transfer pulley (62) mounted on a flywheel shaft (60) for transferring power from said pedal assembly (40);
said flywheel shaft (60) rotatably mounted on said frame;

a main crank belt (37) coupling said first transfer pulley (58) to said main crank pulley (36);

a rear transfer assembly (66) having a third transfer pulley (68) and a fourth transfer pulley (70) mounted on a rear transfer shaft (92);
said rear transfer shaft (92) rotatably mounted on said frame;

a second drive belt (72) coupling said second transfer pulley (62) to said third transfer pulley;

a propeller 30 and a propeller pulley (110) mounted on a propeller shaft (112);

a propeller drive belt (74) coupled to said fourth transfer pulley (70) and said propeller pulley (110);

a propeller drive fastening base (76) having one end journaled on said rear transfer shaft (92) and another end;

a bi-directional pulley assembly means (98) mounted on said another end of said fastening base (76) for directing said propeller drive belt from said fourth transfer pulley (70) to said propeller pulley (110);

means for adjusting tension of said propeller drive belt (74);

a steering tie rod means (88) (78) having one end coupled to said fastening base (76) and another end;

a steering column rotatably mounted on said frame and substantially vertical when said pedal drive apparatus is attached to said boat and having one end coupled to said steering tie rod means (88)(78) and another end having a handle means for permitting a user to orient said propeller in a selected direction, such that said propeller shaft (12) is supportable in a selected orientation and said fourth transfer pulley is coupled to said propeller shaft (110) and rotation of said pedal crankshaft (40) turns said propeller (30) oriented in said selected orientation;

means for supporting a user in a seated position such as to enable said user to pedal said pedal crank and orient said pedal in said selected orientation;

means for attaching said pedal drive apparatus to said boat.

2. The pedal drive apparatus of claim 1 wherein said means for adjusting tension of said propeller drive belt comprises:

a pulley carrier (104) having one end pivotally mounted on said fastening base (76);

a pair of pulleys (100, 102) rotatably mounted on a carrier shaft (104) at another end of said pulley carrier (104);

screw means for adjustably tilting said pulley carrier (104) such as to adjust tension in said propeller pulley drive belt (74).

3. The pedal drive apparatus of claim 1 wherein said handle means is a bicycle handle bar.

4. The pedal drive apparatus of claim 1 wherein said means for supporting a user is a bicycle seat.

5. The pedal drive apparatus of claim 1 which comprises a means for locking said propeller shaft in one of said selected orientations.

6. The pedal drive apparatus of claim 3 which comprises a means for locking said propeller shaft in one of said selected orientation.

7. The apparatus of claim 5 wherein said means for locking comprises:

said handle means being a handle bar;

a pin (48) slidably mounted on said steering column (26) and spring loaded to slide into a hole in said frame;

a steering lock control lever (84) pivotally mounted on said handle bar such that a user grasping said handlebar is enabled to grasp said control lever (84);

a steering lock cable (46) having one end secured to said steering lock lever (84); and a second end secured to an end of said pin (48) such that, when said lever (84) is squeezed, said pin (48) is retracted from said hole and said handle bar can be turned.

* * * * *